US008062554B2

(12) United States Patent
Imholt et al.

(10) Patent No.: US 8,062,554 B2
(45) **Date of Patent: *Nov. 22, 2011**

(54) SYSTEM AND METHODS OF DISPERSION OF NANOSTRUCTURES IN COMPOSITE MATERIALS

(75) Inventors: Timothy J. Imholt, Richardson, TX (US); Jerry M. Grimm, Plano, TX (US); James A. Pruett, Lucas, TX (US); Christopher J. Gintz, Hilton Head Island, SC (US); Graham E. Gintz, Hilton Head Island, SC (US)

(73) Assignee: Raytheon Company, Waltham, MA (US)

( * ) Notice: Subject to any disclaimer, the term of this patent is extended or adjusted under 35 U.S.C. 154(b) by 404 days.

This patent is subject to a terminal disclaimer.

(21) Appl. No.: 12/152,642

(22) Filed: May 14, 2008

(65) Prior Publication Data

US 2010/0038595 A1 Feb. 18, 2010

Related U.S. Application Data

(63) Continuation-in-part of application No. 11/050,884, filed on Feb. 4, 2005, now Pat. No. 7,682,694.

(60) Provisional application No. 60/930,156, filed on May 14, 2007.

(51) Int. Cl.
*H01B 1/00* (2006.01)
*H01B 1/12* (2006.01)

(52) U.S. Cl. ..... 252/500; 252/478; 165/185; 313/311; 427/598; 977/750; 977/752

(58) Field of Classification Search ..... 252/478, 252/500; 165/185; 313/311; 427/598; 977/750, 977/752

See application file for complete search history.

(56) References Cited

U.S. PATENT DOCUMENTS

| | | | | |
|---|---|---|---|---|
| 6,630,772 | B1 * | 10/2003 | Bower et al. | 313/311 |
| 2004/0038007 | A1 | 2/2004 | Kotov et al. | |
| 2005/0061496 | A1 * | 3/2005 | Matabayas, Jr. | 165/185 |
| 2006/0066201 | A1 | 3/2006 | Ra et al. | |
| 2006/0269695 | A1 * | 11/2006 | Daly et al. | 427/598 |
| 2007/0043158 | A1 | 2/2007 | Smalley et al. | |
| 2010/0038595 | A1 * | 2/2010 | Imholt et al. | 252/478 |

FOREIGN PATENT DOCUMENTS

| | | | |
|---|---|---|---|
| WO | WO 01/57284 | A1 * | 8/2001 |
| WO | WO 2005-028549 | A2 * | 3/2005 |

OTHER PUBLICATIONS

Martin et al., "Electric field-induced aligned multi-wall carbon nanotubes networks in epoxy composites", Polymer, 46 (2005), pp. 877-886.*

Zhu et al., "Improving the Dispersion and Integration of Single-Walled Carbon Nanotubes in Epoxy Composites through Functionalization", Nano Letters, vol. 3, No. 8 2003, pp. 1107-1113.*

Koerner et al., "Tuning Polymer Nanocomposite Morphology: AC Electric Field Manipulation of Epoxy-Montmorillonite (Clay) Suspensions", Adv. Mater., 2004, 16, No. 4, Feb. 17, 2004, pp. 297-302.*

Park et a., "Aligned Single-Wall Carbon Nanotube Polymer Composites Using an Electric Field", Journal of Polymer Science Part B: Polymer Physics, 44 (2006), pp. 1751-1762.*

* cited by examiner

*Primary Examiner* — Khanh T Nguyen
(74) *Attorney, Agent, or Firm* — The NOblitt Group, PLLC

(57) ABSTRACT

Apparatus and methods according to various aspects of the present invention may operate in conjunction with composite matrix material and reinforcement material, such as nanostructures. The nanostructures may be evenly dispersed and/or aligned in the matrix material through application of an electromagnetic field, resulting in a nanocomposite material. In one embodiment, the nanocomposite material is suitable for large scale processing.

9 Claims, 2 Drawing Sheets

SYSTEM AND METHODS OF DISPERSION OF NANOSTRUCTURES IN COMPOSITE MATERIALS

CROSS REFERENCE TO RELATED APPLICATIONS

The present application is a continuation-in-part of U.S. patent application Ser. No. 11/050,884, filed on Feb. 4, 2005, now U.S. Pat. No. 7,682,694 entitled Product and Method for Impact Deflecting Materials, and claims the benefit of Provisional Patent Application Ser. No. 60/930,156, filed May 14, 2007, entitled Method of Dispersion of Nanostructures in Composite Materials, and incorporates the disclosure of each such application by reference.

BACKGROUND OF INVENTION

Composite materials are used in various applications that require integrity of mechanical properties, including radomes, aircrafts, high speed airframe components and missiles. Conventional composite materials, however, are limited in their impact resistant properties.

Prior attempts to increase mechanical properties such as tensile strength have included implementation of nanoparticles as reinforcement materials into composite materials. In order to benefit from the mechanical properties of the reinforcement materials, however, substantially even dispersion of the reinforcement materials in the composite material, as well as integrity of the mechanical properties of the reinforcement materials are required.

Current methods of incorporating nanoparticles in matrix material fail to meet these requirements. For example, extrusion, a method involving mixing of nanoparticles with composite material, causes nanoparticles, especially nanotubes, to break. Another example is the method of functionalization, where additional structures, such as fluoride atoms, are attached to the nanoparticles prior to mixing. The additional structures, however, have demonstrated inferior mechanical properties as compared to nanoparticles without such structures. Additionally, these methods fail to prevent nanoparticles from clumping and/or clustering rather than evenly dispersing in resulting composite materials.

SUMMARY OF THE INVENTION

Apparatus and methods according to various aspects of the present invention may operate in conjunction with composite matrix material and reinforcement material, such as nanostructures. The nanostructures may be evenly dispersed and/or aligned in the matrix material through application of an electromagnetic field, resulting in a nanocomposite material. In one embodiment, the nanocomposite material is suitable for large scale processing.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of elements configured to perform the specified functions and achieve the various results. For example, the present invention may employ various nanostructures, composite matrix materials and the like, which may carry out a variety of functions. In addition, the present invention may be practiced in conjunction with any number of composite material applications, and the system described is merely one exemplary application for the invention. Further, the present invention may employ any number of conventional techniques for preparing nanostructures and a composite matrix material, and the like.

Nanocomposite system and methods according to various aspects of the present invention may be implemented in conjunction with a plurality of nanostructures and a composite matrix material. The nanostructures may comprise reinforcement material and may be substantially uniformly dispersed and/or aligned within the composite matrix material through the application of an electromagnetic field. The resulting nanocomposite material may be suitable for large scale production.

The nanocomposite material may be implemented in conjunction with any suitable high strength composite application. For example, the nanocomposite material may serve as a protective layer and/or structural component in a lightweight armor, lightweight air, land and/or water craft, such as a vehicle, aircraft, missile, and/or spacecraft. In providing a protective and/or structural layer, the nanocomposite may be implemented into any application where stealth and/or concealment from detection devices, such as sonar, radar and/or the like.

Additionally, as a protective layer, the nanocomposite material may be implemented as a hull structure for aircraft components, all terrain vehicles, operated either remotely or driven by an operator, and/or personal protective devices, such as shields, body armor, and personal clothing elements that may be implemented to deflect personal assault by any ballistic, such as a firearm, sharp instrument, blast wave triggered by an explosive device.

Figure 1:
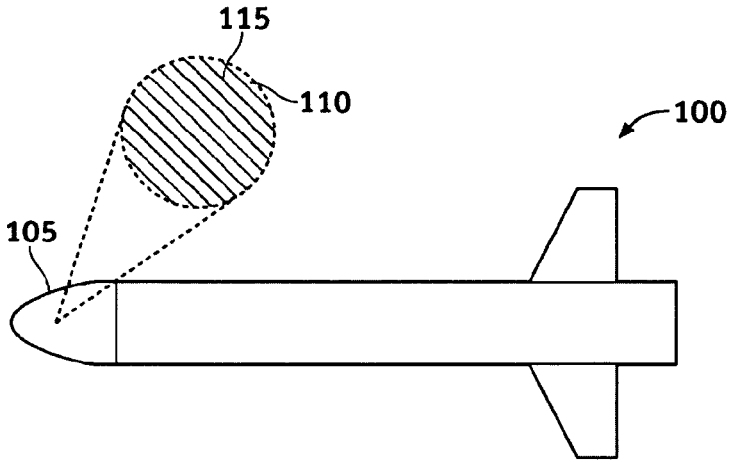
FIG. 1 depicts a nanocomposite reinforced radome application.

In one embodiment, referring now to FIG. 1, the nanocomposite material may be implemented into ballistic shield applications, such as a radome 105 for a missile 100. The radome 105 may be molded from nanocomposite material, wherein the nanocomposite material comprises nanostructures 115 that are substantially uniformly dispersed within the composite matrix material 110.

The composite matrix material 110 in accordance with various aspects of the present invention may comprise any suitable material for surrounding, supporting and/or positioning reinforcement materials, such as nanostructures 115.

Suitable materials may include plastics, polymers, such as epoxy, polystyrene, polybutadiene, polycarbonates, ceramics, metals, and/or glass.

The composite matrix material 110 may be more abundant in the resulting nanocomposite than the reinforcement materials, such as nanostructures 115. Additionally, composite matrix material 110 generally comprises non-conductive or weakly conductive materials, so as to minimize interference with the dispersion and/or alignment of nanostructures through application of a current.

In one embodiment, the composite matrix material 110 may comprise element-based materials, such as carbon and/or boron nitride. The element-based material may be made through any suitable technique, including chemical vapor deposition, arc discharge, and/or laser ablation. For example, carbon based materials may include a graphene material comprising carbon atoms bonded to form a hexagonal shaped matrix. In this embodiment, the material comprises a single layer of carbon atoms, and may be suitable to position nanostructures on one or both sides of the matrix material.

The composite matrix 110 may also comprise a boron matrix made of a single, continuous sheet of triangularly bonded boron atoms. The end of the matrix may be terminated chemically.

In another embodiment, the composite matrix material 110 comprises an epoxy, such as a two-part epoxy. The epoxy may comprise any thermosetting epoxide polymer that cures when mixed with a catalyzing agent.

The composite matrix material 110 may be formed through any suitable curing process. Additionally, prior to and/or during curing the matrix material may be at least partially molded for any suitable application. Prior to and/or during curing, the matrix material 110 may comprise a liquid and/or gel-like composition suitable for mixing with added nanostructures 105.

The nanostructures 105 in accordance with various aspects of the present invention comprise any reinforcement material wherein at least one dimension of the reinforcement material comprises a size range between about 1-100 nanometers. Nanostructures may comprise any suitable man-made and/or natural materials, such as, for example, carbon, boron nitride, copper sulfide and/or the like.

The nanostructures 105 may comprise any suitable thickness within the matrix material 110. For example, the nanostructures 105 may be implemented in a thickness of approximately 0.5 mm. Additionally, the nanostructures may comprise any suitable weight percent of the resulting nanocomposite material, such as, for example, approximately 0.5 to about 4.0 weight percent.

The nanostructures 105 may comprise any suitable shape, such as nanotubes and/or nanorods. In one embodiment, the nanostructures 105 may comprise copper sulfide microtubes and/or nanorods having a diameter of approximately 1-5 micrometers (μm) and a length of tens of μm.

In another embodiment, the nanostructures 105 may comprise boron nitride nanotubes. Generally, the boron nitride nanotubes are semi-conducting and have thermal conductive properties corresponding to approximately 600 Watt per meter per Kelvin (W/m K). Additionally, boron nitride nanotubes comprise mechanical properties of 1.18 TPa, and are stable in temperatures of up to 800° C. in air.

In yet another embodiment, the nanostructures 105 comprise carbon atoms that may be configured into an allotrope of carbon, such as carbon nanotubes. Carbon nanotubes comprise a rolled-up version of another allotrope of carbon, graphene. As a one-carbon-atom-thick planar sheet, graphene comprises individual carbon atoms that are bonded to each other via $sp^2$ covalent bonds to form a honeycomb-like structure.

The carbon nanotubes may have two of three dimensions in the range between about 1-100 nanometers. Additionally, carbon nanotubes comprise various physical and electrical properties suitable for reinforcement materials in composite materials.

For example, in the present embodiment, the covalent $sp^2$ bonds between individual carbon atoms provide for greater strengths than other allotropes of carbon, such as diamonds. Resulting tensile strengths for carbon nanotubes may be as high as 63 gigapascal (GPa). This is approximately 98% stronger than high-carbon steel, which has a tensile strength of about 1.2 GPa. Additionally, carbon nanotubes comprise a high elastic modulus of about 1 terapascal (TPa) to about 1.33 TPa. The elastic modulus is also known the carbon nanotubes tendency to be able to deform elastically. Further, the density of carbon nanotubes, approximately 1.3-1.4 $g/m^3$, provide for superior specific strength to most known materials.

In one embodiment, nanostructures 115 comprising high tensile properties in combination with low compressive properties may be suitable for combination with matrix material comprising high compressive and low tensile strength properties. In this embodiment, the resulting nanocomposite may comprise a synergistic effect of the tensile strength of the nanostructures and the compressive properties of the matrix material.

In another embodiment, carbon nanotubes comprising diameters of 1 nm and smaller that comprise a chirality, such as (10,10), and that are aligned may further optimize the strengthening properties in the aligned direction. For example, the aligned direction may comprise a direction that is perpendicular to the direction of an impact, such as a ballistic threat.

Further, carbon nanotubes may be highly thermally and electrically conductive while maintaining chemical stability in a wide range of temperatures. For example, carbon nanotubes may comprise thermal conductivity of approximately greater than 300 W/m K. Additionally, carbon nanotubes may be stable in temperatures ranging from about 3° C. to about 400° C.

The electrical properties of carbon nanotubes may be metallic and/or semiconducting. The electrical properties of the nanostructures 115 may be modified based on the shape of the nanostructures. In one embodiment, where nanostructures 115 comprise nanotubes, how graphene is rolled up along individual graphene planes may affect the electrical properties of the resulting nanotube. For example, the conductive nature of the nanotubes is at least partially determined based on the structure of the nanotubes.

Figure 3A:
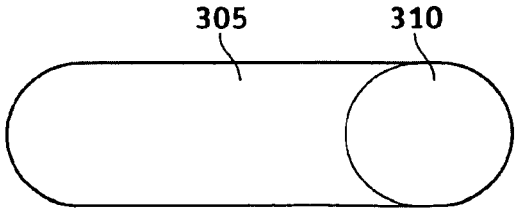
FIGS. 3A-B depict nanostructures.
Figure 3B:
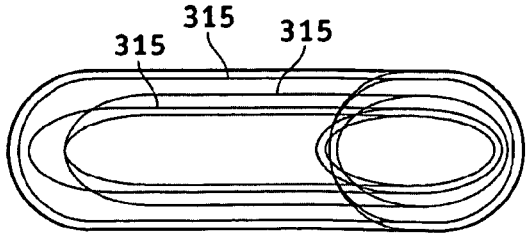

Referring now to FIGS. 3A-B, nanotubes may comprise one or more walls. For example, in FIG. 3A, a single walled nanotube comprises one layer of graphene rolled up into a seamless cylinder to comprise a single wall 305. Single walled nanotubes may further comprise straight tube, zigzag, armchair and/or chiral configurations. The ends of the single walled nanotube may be closed 310 and may comprise a carbon configuration known as the buckyball structure. In one embodiment, single walled nanotubes may have diameters between about 1 nm and about 2 nm, and may comprise tube lengths of from a few nanometers to a few centimeters.

Single walled nanotubes may be semi-conducting and/or conducting. In one embodiment, carbon single wall nanotubes may be collectively comprise both semi-conducting and conducting nanotubes.

In another embodiment, single walled nanotubes may be twisted together to form a nanotube rope. Van der Waals forces, equivalent to about 0.5 ev/nm, allow nanotubes to be held together in the rope configuration. Additionally, the Van der Waals forces add strength to the nanostructures.

In yet another embodiment, nanotubes may comprise multiple walls 315. The multi walled nanotubes comprise a layered structure of graphene tubes nested within one another. The distance between individual nested tubes may comprise the distance between graphene layers of another allotrope of carbon, graphite. This interlayer distance provides for similar electrical conductivity as graphene.

Nanostructures according to various aspects of the present invention are at least partially positive charged, and suitably configured for dispersal within a weakly conductive and/or nonconductive matrix material.

Dispersion of nanostructures in the matrix material according to various aspects of the present invention may be implemented in any suitable manner to obtain a more even amount of nanostructures per unit volume of matrix material. For example, dispersion may be effected through stirring, mixing, blending and/or the like of nanostructures in matrix material. Alternatively and/or conjunctively, an electromagnetic field may be applied to affect uniform dispersion of nanostructures in a matrix material.

Figure 4A:
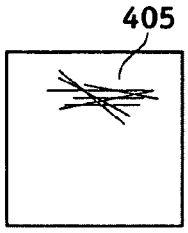
FIGS. 4A-B illustrate nanocomposite material.

Referring now to FIG. 4A, composing nanocomposites solely by mixing and/or blending nanostructures through extrusion and/or functionalization alone may cause clumping and/or clustering of nanotubes 405 in the matrix material, resulting in uneven distribution of nanostructures in the resulting nanocomposite, unsuitable for large scale production.

Figure 2:
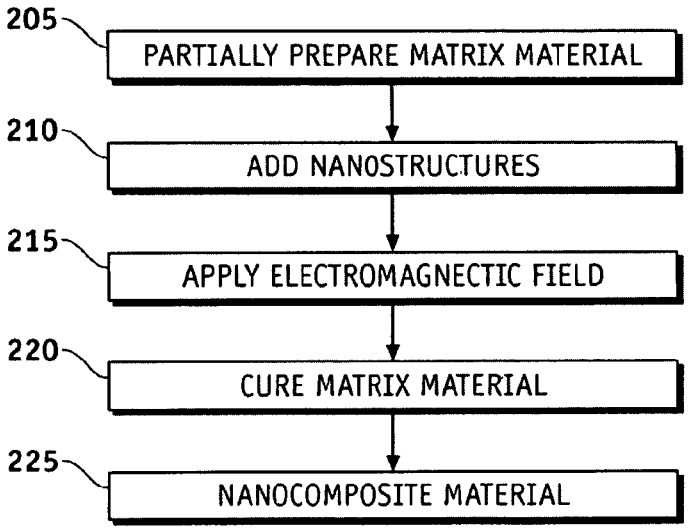
FIG. 2 is a flow chart illustrating a method for preparing a nanocomposite material.
Figure 4B:
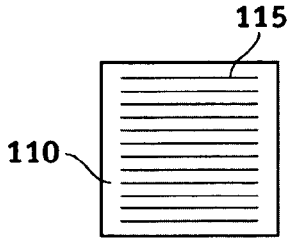

Referring now to FIGS. 2 and 4B, after partially preparing the matrix material 110 (205), nanostructures 115 may be added (210) and an electromagnetic field may be applied (215) during curing of the matrix material 110 (220). The resulting nanocomposite material (225) comprises evenly dispersed and/or aligned nanostructures 115 in the matrix material 110.

Figure 5:
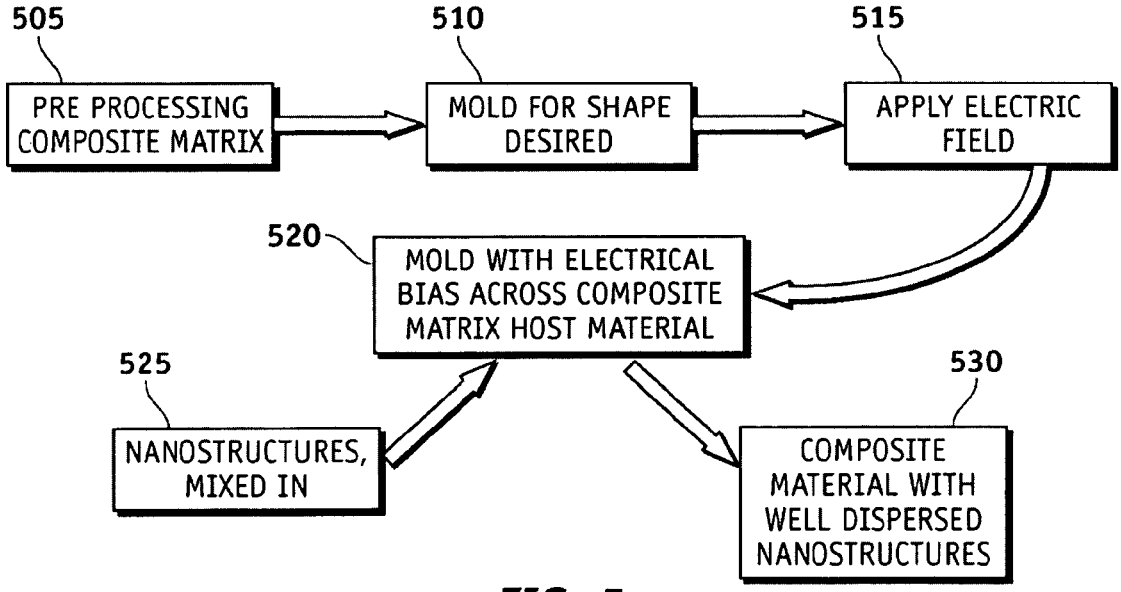
FIG. 5 is a flow chart illustrating a method for preparing a nanocomposite material.

Additional processing may be applied to reduce or inhibit clumping and/or clustering. For example, referring now to FIG. 5, in one embodiment, a preprocessing matrix material 110 may be prepared and (505) molded to a desired shape for any suitable application (510). An electromagnetic field may be applied (515) to the mold comprising the matrix material (520) as nanostructures are mixed in (525) as the matrix material cures. When cured, the resulting nanocomposite material comprises evenly dispersed nanostructures (530).

Figure 6:
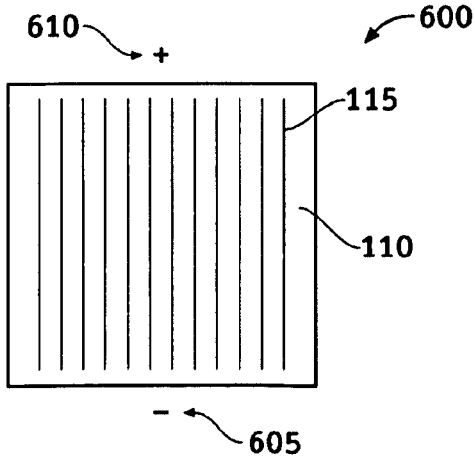
FIG. 6 illustrates a method for preparing a nanocomposite material.

The electromagnetic field may comprise any suitable substantially uniform electromagnetic field, including homogenous, constant, unidirectional and/or uniform electromagnetic field. Referring now to FIG. 6, an electromagnetic field is applied across a chamber and/or mold 600 comprising the matrix material and added nanostructures, where one end of the chamber comprises a positive differential charge 605 and the other end comprises a negative charge 610.

The electromagnetic field 600 may be oriented in any suitable manner. For example, in one embodiment, the electromagnetic field 600 is oriented in the linear dimension. This may be effected through implementation of a rectangular applicator, wherein the plate housing the matrix material comprises a substantially cylindrical shape, and wherein the negative charge is applied through the bottom of the plate while the positive charge is applied through the top of the plate.

In another embodiment, the electromagnetic field 600 may be applied in the radial dimension. In this embodiment, the plate housing the uncured matrix material 110 may comprise a circular shape, wherein one negative electrode enters the plate through the bottom and center. The positive electrode may be all around the edge of the circular plate.

The plate housing the matrix material 110 may comprise any suitable plate in any suitable dimension. For example, in one embodiment, the plate comprises a plastic, ceramic and/or glass plate. In another embodiment, the plate may be suitably configured to house matrix material that is approximately 12 mm thick and/or 95 mm in diameter. In various other embodiments of the present invention, the plates may be scaled up for large scale production.

The voltage applied according to various aspects of the present invention comprises any suitable voltage stronger than the Van der Waals forces between nanostructures 115. In one embodiment, the voltage applied may be approximately 6 volts. In another embodiment, the voltage applied may be 6 volts per 95 mm diameter plate.

The strength of the electromagnetic field 600 may be at least partially determined based on the electrical properties of the nanostructures 115 and the matrix material 110. Specifically, the movement of the nanostructures 115 in the matrix material 110 when current is applied may be governed by the following:

$$F=qE$$

where F is the Lorentz force, q is the charge carried by the nanostructures, and E is the electromagnetic field. Here, the migration of the nanostructures caused by the passing of electromagnetic current is countered by forces of friction. The measurement of how quickly the nanostructures move is proportional to and uniform in a constant and homogenous electromagnetic field, as shown by the following:

$$F=vf$$

therefore $$qE=vf$$

where v is the velocity and f is the coefficient of friction in this case. The mobility of the nanostructure (electrophoretic mobility) may be governed by the following:

$$\mu=v/E=q/f$$

In one embodiment, this equation is applied to non-conductive matrix materials. In this embodiment, the mobility may be given by the following:

$$\mu=(\epsilon\,\epsilon_0\zeta)/\eta$$

where $\epsilon$ is the dielectric constant of the matrix material, $\epsilon_{0\ is}$ the permittivity of free space, $\zeta$ is the surface potential of the nanostructure, and $\eta$ is the viscosity of the matrix material.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

The terms "comprise", "comprises", "comprising", "having", "including", "includes" or any variation of such terms, refer to a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A method for dispersing nanostructures in a composite matrix material, comprising:

adding a plurality of nanostructures into the composite matrix material; and applying a substantially uniform electromagnetic field to the composite matrix material in a radial direction extending between an interior point of the composite matrix material and an outer edge of the composite matrix material, wherein the application of the electromagnetic field causes the plurality of nanostructures to:

substantially disperse throughout the composite matrix material; and substantially align with the electromagnetic field.

2. The method of claim 1, wherein the electromagnetic field is applied until the composite matrix material is substantially cured.

3. The method of claim 1, wherein the composite matrix material comprises at least one of a polymer, a metal, a plastic, epoxy, polystyrene, polybutadiene, polycarbonate, a ceramic, a glass, a graphene, a graphite, and boron nitride.

4. The method of claim 1, wherein the nanostructures comprise a positive charge.

5. The method of claim 1, wherein the nanostructures comprise at least one of a nanotube, a single walled nanotube, a single walled nanotube further comprising a rope, and a multiple walled nanotube.

6. The method of claim 1, wherein the nanostructures comprise at least one of carbon, boron nitride, and copper sulfide.

7. The method of claim 1, wherein the nanostructures comprise a tensile strength of approximately 63 GPa.

8. The method of claim 1, wherein the nanostructures are substantially aligned along an electromagnetic field within the composite matrix material.

9. The method of claim 1, wherein the nanostructures comprise about 0.5 to about 4.0 weight percent of the composite matrix material.

* * * * *